US010273566B2

(12) United States Patent
Maeda et al.

(10) Patent No.: US 10,273,566 B2
(45) Date of Patent: Apr. 30, 2019

(54) HOT-ROLLED STEEL SHEET AND METHOD FOR PRODUCING SAME

(71) Applicant: NIPPON STEEL & SUMITOMO METAL CORPORATION, Tokyo (JP)

(72) Inventors: Daisuke Maeda, Narita (JP); Osamu Kawano, Oita (JP); Junji Haji, Oita (JP); Fuminori Tasaki, Oita (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 110 days.

(21) Appl. No.: 14/650,086

(22) PCT Filed: Dec. 11, 2012

(86) PCT No.: PCT/JP2012/082059
§ 371 (c)(1),
(2) Date: Jun. 5, 2015

(87) PCT Pub. No.: WO2014/091554
PCT Pub. Date: Jun. 19, 2014

(65) Prior Publication Data

US 2015/0315683 A1 Nov. 5, 2015

(51) Int. Cl.
*C21D 6/00* (2006.01)
*C21D 8/02* (2006.01)
(Continued)

(52) U.S. Cl.
CPC ..... *C22C 38/50* (2013.01); *C21D 6/001* (2013.01); *C21D 6/002* (2013.01); *C21D 6/004* (2013.01);
(Continued)

(58) Field of Classification Search
CPC ..... C22C 38/04
See application file for complete search history.

(56) References Cited

U.S. PATENT DOCUMENTS

2002/0088510 A1 7/2002 Nagataki et al.
2007/0037006 A1* 2/2007 Yokoi ..... C21D 8/0226 428/659
(Continued)

FOREIGN PATENT DOCUMENTS

CN 101713046 A 5/2010
CN 102703824 A 10/2012
(Continued)

OTHER PUBLICATIONS

Chinese Office Action and Search Report dated Mar. 1, 2016, for Chinese Application No. 201280077560.6 with the English translation.
(Continued)

*Primary Examiner* — Colin W. Slifka
(74) *Attorney, Agent, or Firm* — Birch, Stewart, Kolasch & Birch, LLP

(57) ABSTRACT

A hot-rolled steel sheet includes, as a chemical composition, by mass %, C: 0.030% to 0.10%, Mn: 0.5% to 2.5%, and Si+Al: 0.100% to 2.5%, in which the steel sheet has a microstructure including, by area fraction, ferrite: 80% or more, martensite: 3% to 15.0%, and pearlite: less than 3.0%, in which a number density of martensite having an equivalent circle diameter of 3 μm or more at a position which is at a depth of ¼ of the steel sheet thickness from the surface of the steel sheet, is 5.0 pieces/10000 μm$^2$ or less, and the following Expression (1) is satisfied.

$$R/D_M^2 \geq 1.00 \quad \text{Expression (1)}$$

Here, R is an average martensite interval (μm) defined by the following Expression (2), and $D_M$ is a martensite average diameter (μm).

$$R=\{12.5\times(\pi/6V_M)^{0.5}-(2/3)^{0.5}\}\times D_M \quad \text{Expression (2)}$$

Here, $V_M$ is a martensite area fraction (%) and $D_M$ is the martensite average diameter (μm).

13 Claims, 2 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 6/005* (2013.01); *C21D 6/008* (2013.01); *C21D 8/0226* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/46* (2013.01); *C22C 38/48* (2013.01); *C22C 38/58* (2013.01); *C21D 2211/005* (2013.01); *C21D 2211/008* (2013.01)

(56) References Cited

U.S. PATENT DOCUMENTS

| | | | |
|---|---|---|---|
| 2013/0098515 | A1 | 4/2013 | Tanaka et al. |
| 2013/0266821 | A1 | 10/2013 | Kawasaki et al. |
| 2014/0000769 | A1 | 1/2014 | Takahashi et al. |

FOREIGN PATENT DOCUMENTS

| | | | | |
|---|---|---|---|---|
| EP | 1193322 | A1 | | 4/2002 |
| EP | 1195447 | A1 | | 4/2002 |
| JP | 2003-089848 | A | | 3/2003 |
| JP | 2003-193190 | A | | 7/2003 |
| JP | 2003-293083 | A | | 10/2003 |
| JP | 2004-84074 | A | | 3/2004 |
| JP | 2004-143518 | A | | 5/2004 |
| JP | 2004-204326 | A | | 7/2004 |
| JP | 2006-316301 | A | | 11/2006 |
| JP | 2007-39749 | A | | 2/2007 |
| JP | 2007-063668 | A | | 3/2007 |
| JP | 2007-302918 | A | | 11/2007 |
| JP | 2008-138231 | A | | 6/2008 |
| JP | 2010-024547 | A | | 2/2010 |
| JP | 2011-184788 | A | | 9/2011 |
| JP | 2011184788 | A | * | 9/2011 |
| JP | 2013-019048 | A | | 1/2013 |
| TW | 201213561 | A1 | | 4/2012 |
| TW | 201217547 | A1 | | 5/2012 |
| TW | 201243063 | A1 | | 11/2012 |
| WO | WO 2011/135997 | A1 | | 11/2011 |
| WO | WO 2012/128228 | A1 | | 9/2012 |

OTHER PUBLICATIONS

International Search Report issued in PCT/JP2012/082059, dated Mar. 5, 2013.

Office Action issued in Japanese Patent Application No. 2012-133652, dated Apr. 15, 2014.

Office Action issued in Taiwanese Patent Application No. 101146379, dated Dec. 8, 2014.

Korean Office Action for Korean Application No. 10-2015-7016246, dated Sep. 20, 2016, with an English translation.

Extended European Search Report dated Dec. 17, 2015, for European Application No. 12890068.5.

* cited by examiner

HOT-ROLLED STEEL SHEET AND METHOD FOR PRODUCING SAME

TECHNICAL FIELD OF THE INVENTION

The present invention relates to a hot-rolled steel sheet and a method for producing the same. More specifically, the present invention relates to a high-strength hot-rolled steel sheet having excellent elongation and hole expandability and a method for producing the same.

RELATED ART

In recent years, due to growing worldwide awareness of the environment, there has been strong demand in the automotive field to reduce carbon dioxide emission and improve fuel consumption. For solving these tasks, weight reduction of a vehicle body may be very effective, and application of a high-strength steel sheet is being promoted to achieve the weight reduction. At present, a hot-rolled steel sheet having a tensile strength of a 440 MPa class is often used in automotive suspension parts. However, in order to achieve weight reduction of a vehicle body, application of a steel sheet having a higher strength is desired.

Many suspension members of an automobile have a complicated shape in order to secure high rigidity. Accordingly, multiple kinds of works such as burring, stretch flanging, and elongation are applied thereto during press forming, and thus, workability responding to these kinds of works is required in the hot-rolled steel sheet as a material. Generally, the burring workability and the stretch flanging workability have a correlation with a hole expanding ratio measured in a hole expanding test, and many studies for increasing the hole expanding ratio have been heretofore advanced.

While dual phase steel (hereinafter, referred to as "DP steel") consisting of ferrite and martensite has high strength and excellent elongation, the hole expandability thereof is low. This is because high amounts of strain and stress concentration occur in the ferrite near the martensite with forming due to a large difference in the strength between the ferrite and the martensite and thus cracks are generated. From this finding, a hot-rolled steel sheet with an improved hole expanding ratio done by reducing the difference in strength between structures has been developed.

In Patent Document 1, a steel sheet that includes bainite or bainitic ferrite as a primary phase so as to secure the strength and significantly improve hole expandability thereof is proposed. When single structure steel is formed, the above-described strain and stress concentration do not occur and a high expanding ratio can be obtained. However, even when the single structure steel composed of bainite or bainitic ferrite is formed, it is difficult to secure high elongation and thus high levels of both elongation and hole expandability are not easily attained.

In recent years, steel sheets in which ferrite having excellent elongation is used as a structure of single structure steel and high strength is achieved by using carbides such as Ti and Mo are proposed (for example, refer to Patent Documents 2 and 3). However, the steel sheet proposed in Patent Document 2 contains a large amount of Mo and the steel sheet proposed in Patent Document 3 contains a large amount of V.

In addition, in Patent Document 4, a complex structure steel sheet in which martensite in DP steel is changed into bainite and the difference in strength between structures of ferrite and bainite is reduced to improve hole expandability has been proposed. However, when the area fraction of the bainite structure is increased to secure the strength, as a result, it is difficult to secure high elongation and thus high levels of both elongation and hole expandability are not easily attained. Further, in Patent Document 5, a high-strength steel sheet having excellent hole expandability and formability by attaining both strength and hole expandability using ferrite having excellent ductility and tempered martensite by controlling the amount of C solid-soluted in ferrite before quenching, in addition to quenching and tempering martensite after quenching in order to attain hole expandability and formability is disclosed. However, in recent years, it has been desired to further improve the balance between elongation and hole expandability.

PRIOR ART DOCUMENT

Patent Document

[Patent Document 1] Japanese Unexamined Patent Application, First Publication No. 2003-193190

[Patent Document 2] Japanese Unexamined Patent Application, First Publication No. 2003-089848

[Patent Document 3] Japanese Unexamined Patent Application, First Publication No. 2007-063668

[Patent Document 4] Japanese Unexamined Patent Application, First Publication No. 2004-204326

[Patent Document 5] Japanese Unexamined Patent Application, First Publication No. 2007-302918

DISCLOSURE OF THE INVENTION

Problems to be Solved by the Invention

The present invention is to provide a high-strength hot-rolled steel sheet capable of attaining excellent elongation and hole expandability without containing an expensive element, and a method for producing the same.

Means for Solving the Problem

The inventors have conducted a detailed investigation of the relationship between the structural composition of DP steel having high strength and high elongation and hole expandability, and examined a method for improving both elongation and hole expandability with respect to the type of steel in the related art. As a result, the inventors have found a method for improving hole expandability while maintaining high elongation of the DP steel by controlling the dispersion state of martensite therein. That is, it has been found that even in a DP structure in which a difference in strength is large like in structures of ferrite and martensite, and the hole expandability is generally low, when the relationship of $R/D_M^2 \geq 1.00$, which will be described later, is satisfied by controlling the area fraction of martensite and the average diameter, the hole expandability can be improved while high elongation is maintained.

The present invention is made based on the above findings and the gist thereof is as follows.

(1) According to a first aspect of the present invention, there is provided a hot-rolled steel sheet including, as a chemical composition, by mass %, C: 0.030% to 0.10%, Mn: 0.5% to 2.5%, Si+Al: 0.100% to 2.5%, P: 0.04% or less, S: 0.01% or less, N: 0.01% or less, Nb: 0% to 0.06%, Ti: 0% to 0.20%, V: 0% to 0.20%, W: 0% to 0.5%, Mo: 0% to 0.40%, Cr: 0% to 1.0%, Cu: 0% to 1.2%, Ni: 0% to 0.6%, B: 0% to 0.005%, REM: 0% to 0.01%, Ca: 0% to 0.01%, and a remainder consisting of Fe and impurities, in which the steel sheet has a microstructure including, by area fraction, ferrite: 80% or more, martensite: 3% to 15.0%, and pearlite: less than 3.0%, in which the number density of martensite having an equivalent circle diameter of 3 μm or more at a position which is at a depth of ¼ of the steel sheet thickness from the surface of the steel sheet, is 5.0 pieces/10000 $\mu m^2$ or less, and the following Expression (A) is satisfied.

$$R/D_M^2 \geq 1.00 \quad \text{Expression (A)}$$

Here, R is an average martensite interval (μm) defined by the following Expression (B), and $D_M$ is a martensite average diameter (μm).

$$R=\{12.5\times(\pi/6V_M)^{0.5}-(2/3)^{0.5}\}\times D_M \quad \text{Expression (B)}$$

Here, $V_M$ is a martensite area fraction (%) and $D_M$ is the martensite average diameter (μm).

(2) The hot-rolled steel sheet according to (1) may further include, as a chemical composition, by mass %, at least one of Nb: 0.005% to 0.06% and Ti: 0.02% to 0.20%.

(3) The hot-rolled steel sheet according to (1) or (2) may further include, as a chemical composition, by mass %, at least one of V: 0.02% to 0.20%, W: 0.1% to 0.5%, and Mo: 0.05% to 0.40%.

(4) The hot-rolled steel sheet according to any one of (1) to (3) may further include, as a chemical composition, by mass %, at least one of Cr: 0.01% to 1.0%, Cu: 0.1% to 1.2%, Ni: 0.05% to 0.6%, and B: 0.0001% to 0.005%.

(5) The hot-rolled steel sheet according to any one of (1) to (4) may further include, as a chemical composition, by mass %, at least one of REM: 0.0005% to 0.01% and Ca: 0.0005% to 0.01%.

(6) According to a second aspect of the present invention, there is provided a method for producing a hot-rolled steel sheet including heating a slab having the chemical composition according to any one of (1) to (5) to 1150° C. to 1300°, then subjecting the slab to multipass rough rolling and rolling the slab with four or more final passes of rolling in a temperature range of 1000° C. to 1050° C. at a total reduction of 30% or more to form a rough bar, starting rolling on the rough bar within 60 seconds after completing the rough rolling and subjecting the rough bar to finish rolling to complete rolling in a temperature range of 850° C. to 950° C. to obtain a finish-rolled steel sheet, and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

Effects of the Invention

According to the present invention, it is possible to obtain a high-strength hot-rolled steel sheet having excellent elongation and hole expandability without containing an expensive element, and the present invention significantly contributes to the industry.

EMBODIMENTS OF THE INVENTION

DP steel is a steel sheet in which hard martensite is dispersed in soft ferrite and high strength and high elongation are realized. However, strain and stress concentration resulting from a difference in strength between ferrite and martensite occurs during deformation and voids which cause ductile fractures are easily formed. Therefore, the hole expandability is very low. However, a detailed investigation of void formation behavior has not been conducted and a relationship between the microstructure of the DP steel and ductile fractures has not been always clear.

Here, the present inventors have conducted a detailed investigation of a relationship between structures and void formation behavior and a relationship between void formation behavior and hole expandability in DP steel having various structural compositions. As a result, it has been found that the hole expandability of the DP steel is significantly affected by the dispersion state of martensite, which is a hard second phase structure. Further, it has been found that when a value obtained by dividing the average martensite interval obtained using Expression (1) by the square of a martensite average diameter is set to 1.00 or more, even in structures having a large difference in strength between the structures like the DP steel, high hole expandability can be obtained.

Cracks during hole expanding are generated and propagated by ductile fractures having an elementary process of forming, expanding, and connecting voids. In the structure having a large difference in strength between structures like DP steel, high levels of strain and stress concentration caused by hard martensite are generated and thus voids are easily formed and the hole expandability is low.

However, when the relationship between the structure and the void formation behavior and the relationship between the void formation behavior and the hole expandability are investigated, it has been found that there may be a case in which the formation, growth, and connection of voids is delayed depending on the dispersion state of martensite, which is a hard second phase, and high hole expandability can be obtained.

Specifically, it has been found that void formation is delayed by refining the grain size of martensite. It is thought that this is because the grain size of the martensite is reduced and a strain and stress concentration region formed near the martensite is narrowed. In addition, it has been also found that when an interval between martensite grains, which is changed according to the number density and average diameter of the martensite, is increased, the distance between voids formed using the martensite as a starting point is increased and the voids are not easily coupled.

Figure 1:
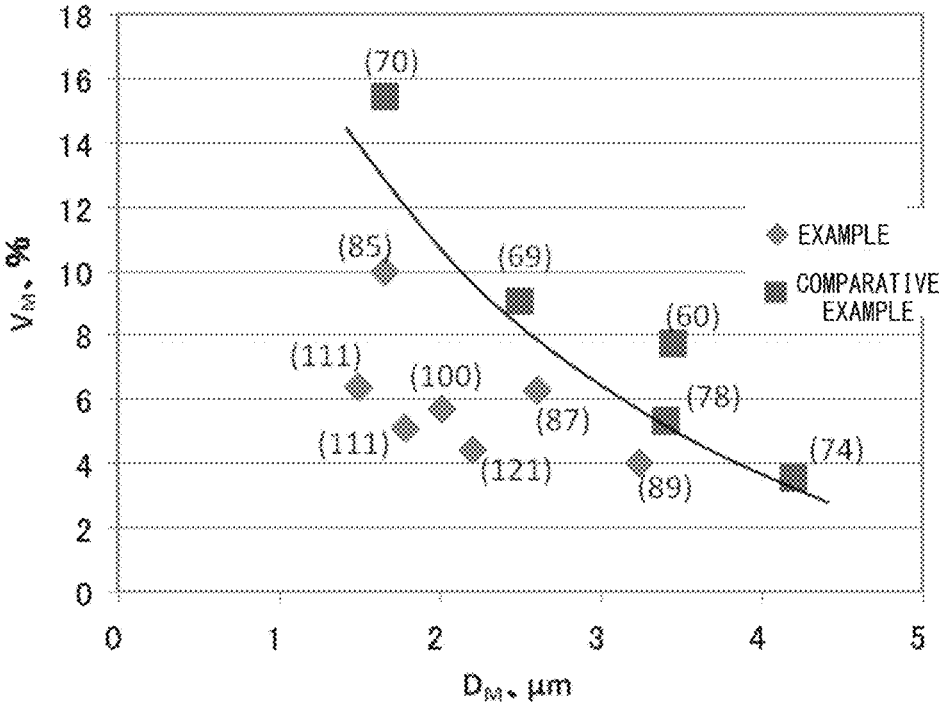
FIG. 1 is a diagram showing the relationship between a martensite average diameter (μm) $D_M$ and a martensite area fraction $V_M$ (%) and numerical values in parentheses represent hole expanding ratios (%).

The investigation of the DP structure having high hole expandability has been conducted based on the above findings. As a result, as shown in FIG. 1 showing the relationship between the martensite average diameter (μm) $D_M$ and the martensite area fraction $V_M$ (%), it has been found that high hole expandability can be obtained by controlling the area fraction and grain size of the martensite to fall within a predetermined range. In addition, in FIG. 1, numerical values in parentheses represent hole expanding ratios (%).

Figure 2:
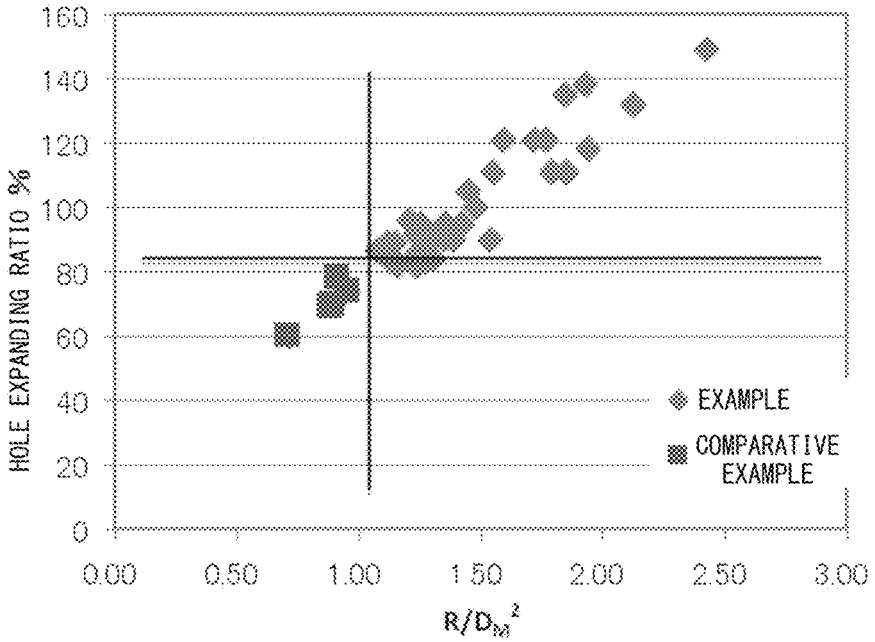
FIG. 2 is a diagram showing the relationship between $R/D_M^2$ obtained by dividing an average martensite interval R by the square of a martensite average diameter $D_M$ and a hole expanding ratio (%).

Further, a relationship between $R/D_M^2$ obtained by dividing the average martensite interval R by the square of a martensite average diameter $D_M$ and a hole expanding ratio (%) are shown. As shown in FIG. 2, it has been found that $R/D_M^2$ on the left side in the following Expression (1) has a clear correlation with the hole expanding ratio (%) and when $R/D_M^2$ is 1.00 or more, high hole expandability can be obtained even in the DP structure so as to obtain a hot-rolled steel sheet having excellent elongation and hole expandability.

$$R/D_M^2 \geq 1.00 \quad \text{Expression (1)}$$

Here, R is an average martensite interval (μm) defined by the following Expression (2), and $D_M$ is a martensite average diameter (μm).

$$R=\{12.5\times(\pi/6V_M)^{0.5}-(2/3)^{0.5}\}\times D_M \quad \text{Expression (2)}$$

Here, $V_M$ is a martensite area fraction (%) and $D_M$ is the martensite average diameter (μm).

In Expression (1), difficulty in formation and connection of voids is expressed and the average martensite interval R obtained from the area fraction and the average diameter of martensite by Expression (2) is divided by the square of the average diameter of martensite. In the specification, the average diameter of martensite refers to an arithmetic average of martensite having an equivalent circle diameter of 1.0 μm or more. This is because formation and connection of voids are not affected by martensite having an equivalent circle diameter of less than 1.0 μm. As the distance between martensite grains increases, voids formed using martensite as a starting point are not easily coupled and formation and connection of voids are suppressed by refining the martensite.

The reason for suppressing the connection of voids by refining the martensite is not clear but it is thought that the reason is that the growth of voids is delayed. When the grain size of martensite is small, the size of voids formed using martensite as a starting point is also refined. The formed voids grow to be connected to each other. However, a ratio between a void surface area and a void volume is increased with refinement of the size of the voids, that is, the surface tension is increased, and thus the growth of voids is delayed.

Figure 3:
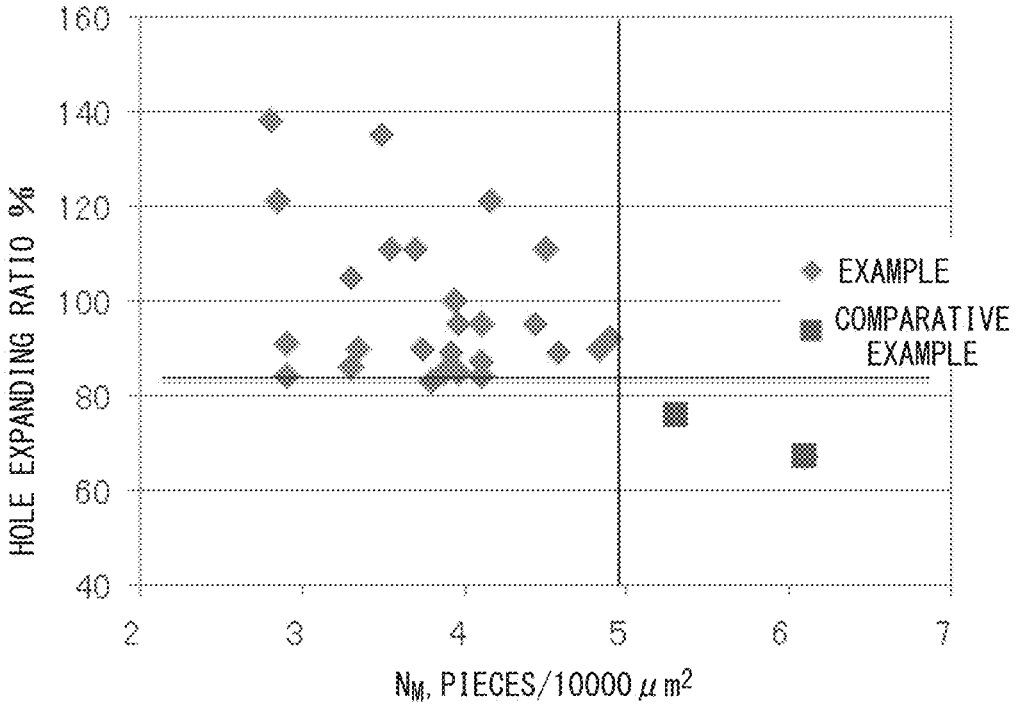
FIG. 3 is a diagram showing the relationship between a number density $N_M$ (pieces/10000 $\mu m^2$) of martensite having an equivalent circle diameter of 3 μm or more at a position which is at a depth of ¼ of the thickness from the surface of a steel sheet, and a hole expanding ratio (%).

However, as shown in FIG. 3 showing the relationship between a number density $N_M$ (pieces/10000 $\mu m^2$) of martensite having an equivalent circle diameter of 3 μm or more at a position which is at a depth of ¼ of the steel sheet thickness from the surface of the steel sheet and a hole expanding ratio (%), it has been found that even in the case in which Expression (1) is satisfied, when coarse martensite is present, local fractures are propagated and the hole expandability is lowered. In order to prevent the hole expandability from being lowered, it is necessary that the number density of martensite having an equivalent circle diameter of 3 μm or more at a depth position which is at a depth of ¼ of the steel sheet thickness be 5.0 pieces/10000 $\mu m^2$ or less. In addition, FIG. 3 shows that when the number density (pieces/10000 $\mu m^2$) of martensite having an equivalent circle diameter of 3 μm or more is 5.0 or more, the hole expandability is lowered. In this graph, only data in which $R/D_M^2$ is 1.00 or more is shown.

Hereinafter, the chemical composition of the hot-rolled steel sheet of the present invention will be described in detail. "%" representing the amount of each element included means mass %.

(C: 0.030% to 0.10%)

C is an important element which contributes to strengthening by forming martensite. When the amount of C is less than 0.030%, it is difficult to form martensite. Accordingly, the amount of C is set to 0.030% or more. The amount of C is preferably 0.04% or more. On the other hand, when the amount of C is more than 0.10%, the area fraction of martensite is increased and the hole expandability is lowered. Accordingly, the amount of C is set to 0.10% or less. The amount of C is preferably 0.07% or less.

(Mn: 0.5% to 2.5%)

Mn is an important element related to the strengthening of ferrite and hardenability. When the amount of Mn is less than 0.5%, the hardenability is increased and it is difficult to form martensite. Accordingly, the amount of Mn is set to 0.5% or more. The amount of Mn is preferably 0.8% or more and more preferably 1.0% or more. On the other hand, when the amount of Mn is more than 2.5%, it is difficult to from a sufficient amount of ferrite. Therefore, the amount of Mn is set to 2.5% or less. The amount of Mn is preferably 2.0% or less and more preferably 1.5% or less.

(Si+Al: 0.100% to 2.5%)

Si and Al are important elements related to the strengthening of ferrite and formation of ferrite. When the total amount of Si and Al is less than 0.100%, the amount of ferrite to be formed is not sufficient and thus it is difficult to obtain a desired microstructure. Accordingly, the total amount of Si and Al is set to 0.100% or more. The total amount of Si and Al is preferably 0.5% or more and more preferably 0.8% or more. On the other hand, when the total amount of Si and Al is more than 2.5%, the effects are saturated and costs increase. Therefore, the total amount of Si and Al is set to 2.5% or less. The total amount of Si and Al is preferably 1.5% or less and more preferably 1.3% or less.

Here, Si has high performance in strengthening ferrite and is capable of more effectively strengthening ferrite than Al. Therefore, from the viewpoint of effectively strengthening ferrite, the amount of Si is preferably 0.30% or more. More preferably, the amount of Si is 0.60% or more. On the other hand, when the amount of Si is large, red scale is generated on the surface of the steel sheet and the appearance is deteriorated in some cases. Therefore, from the viewpoint of suppressing generation of red scale, the amount of Si is preferably 2.0% or less. More preferably, the amount of Si is 1.5% or less.

Since Al has an action of strengthening ferrite and promoting the formation of ferrite like Si, the amount of Si can be suppressed by increasing the amount of Al, and as a result, generation of the above-mentioned red scale is easily suppressed. Therefore, from the viewpoint of easily suppressing the red scale, the amount of Al is preferably 0.010% or more. More preferably, the amount of Al is 0.040% or more. On the other hand, from the viewpoint of strengthening ferrite as described above, it is preferable that the amount of Si is increased. Accordingly, from the viewpoint of strengthening ferrite, the amount of Al is preferably less than 0.300%. More preferably, the amount of Al is less than 0.200%.

(P: 0.04% or less)

P is an element that is generally contained as an impurity and when the amount of P is more than 0.04%, the welding zone is remarkably embrittled. Therefore, the amount of P is set to 0.04% or less. The lower limit of the amount of P is not particularly limited. However, when the amount of P is less than 0.0001%, it is economically disadvantageous. Therefore, the amount of P is preferably 0.0001% or more.

(S: 0.01% or less)

S is an element that is generally contained as an impurity and adversely affects the weldability and productivity during casting and hot rolling. Accordingly, the amount of S is set to 0.01% or less. In addition, when an excessive amount of S is contained, coarse MnS is formed and the hole expandability is lowered. Thus, in order to improve the hole expandability, the amount of S is preferably reduced. The lower limit of the amount of S is not particularly limited. However, when the amount of S is less than 0.0001%, it is economically disadvantageous. Therefore, the amount of S is preferably 0.0001% or more.

(N: 0.01% or less)

N is an element that is generally contained as an impurity and when the amount of N is more than 0.01%, coarse nitrides are formed and the bendability and the hole expandability are deteriorated. Accordingly, the amount of N is set to 0.01% or less. In addition, when the amount of N is increased, N generates blow holes during welding and thus the amount of N is preferably reduced. The lower limit of the amount of N is not particularly limited and the less, the more preferable. When setting the amount of N to less than 0.0005%, production costs increase. Therefore, the amount of N is preferably 0.0005% or more.

The chemical composition of the steel sheet of the present invention may further contain Nb, Ti, V, W, Mo, Cr, Cu, Ni, B, REM, and Ca as optional elements. Since these elements are contained in the steel as optional elements, the lower limits thereof are not particularly defined.

(Nb: 0% to 0.06%)

(Ti: 0% to 0.20%)

Nb and Ti are elements related to the precipitation strengthening of ferrite. Accordingly, either or both of these elements may be contained. However, when the amount of Nb to be contained is more than 0.06%, ferrite transformation is significantly delayed and thus elongation is deteriorated. Accordingly, the amount of Nb is set to 0.06% or less. The amount of Nb is preferably 0.03% or less and more preferably 0.025% or less. In addition, when the amount of Ti contained is more than 0.20%, the ferrite is excessively strengthened and thus high elongation cannot be obtained. Therefore, the amount of Ti is set to 0.20% or less. The amount of Ti is preferably 0.16% or less and more preferably 0.14% or less. In order to more reliably strengthen the ferrite, the amount of Nb is preferably 0.005% or more, more preferably 0.01% or more, and particularly preferably 0.015% or more. Further, the amount of Ti is preferably 0.02% or more, more preferably 0.06% or more, and particularly preferably 0.08% or more.

(V: 0% to 0.20%)

(W: 0% to 0.5%)

(Mo: 0% to 0.40%)

V, W, and Mo are elements contributing to the strengthening of steel. Accordingly, the steel may contain at least one element among these elements. However, when these elements are excessively contained, the formability is deteriorated in some cases. Therefore, the amount of V is set to 0.20% or less, the amount of W is set to 0.5% or less, and the amount of Mo is set to 0.40% or less. In order to obtain a more reliable effect of increasing the strength of steel, the amount of V is preferably 0.02% or more, the amount of W is preferably 0.02% or more, and the amount of Mo is preferably 0.01% or more.

(Cr: 0% to 1.0%)

(Cu: 0% to 1.2%)

(Ni: 0% to 0.6%)

(B: 0% to 0.005%)

Cr, Cu, Ni and B are elements having an action of increasing the strength of steel. Accordingly, the steel may contain at least one element among these elements. However, when these elements are excessively contained, the formability is deteriorated in some cases. Therefore, the amount of Cr is set to 1.0% or less, the amount of Cu is set to 1.2% or less, the amount of Ni is set to 0.6% or less and the amount of B is set to 0.005% or less. In order to obtain a more reliable effect of increasing the strength of steel, the amount of Cr is preferably 0.01% or more, the amount of Cu is preferably 0.01% or more, the amount of Ni is preferably 0.01% or more and the amount of B is preferably 0.0001% or more.

(REM: 0% to 0.01%)

(Ca: 0% to 0.01%)

REM and Ca are elements effective in controlling the shape of oxides and sulfides. Accordingly, the steel may contain at least one element among these elements. However, when these elements are excessively contained, the formability is deteriorated in some cases. Therefore, the amount of REM is set to 0.01% or less, and the amount of Ca is set to 0.01% or less. In order to more reliably control the shape of oxides and sulfides, the amount of REM is preferably 0.0005% or more, and the amount of Ca is preferably 0.0005% or more. In the present invention, REM refers to La and elements in the lanthanoid series. REM is added in the form of misch metal in many cases and there is a case in which a combination of La and elements in the lanthanoid series such as Ce are contained therein. Metallic La and Ce may be contained therein. A remainder includes Fe and impurities.

Hereinafter, the microstructure of the present invention will be described in detail.

(Ferrite: 80% or more)

Ferrite is the most important structure for securing the elongation. When the area fraction of ferrite is less than 80%, high elongation of the DP steel of the related art cannot be realized. Accordingly, the area fraction of ferrite is set to 80% or more. On the other hand, the upper limit of the area fraction of ferrite is determined by the area fraction of martensite, which will be described later, and when the area fraction of ferrite is more than 97%, the amount of martensite is too small and thus it is difficult to utilize strengthening through martensite. Even when another method, for example, a method of increasing the amount of precipitation strengthening, is used to secure the strength thereof, uniform elongation is deteriorated and thus it is difficult to obtain high elongation.

(Martensite: 3% to 15.0%)

(Number density of martensite having average diameter of 3 μm or more: 5.0 pieces/10000 $\mu m^2$ or less)

Martensite is an important structure for securing the strength and the elongation of steel. When the area fraction of martensite is less than 3%, it is difficult to secure excellent uniform elongation. Accordingly, the area fraction of martensite is set to 3% or more. On the other hand, when the area fraction of martensite is more than 15%, the hole expandability is deteriorated. Therefore, the area fraction of martensite is set to 15.0% or less.

In addition when coarse martensite is present, local fracture is propagated and the hole expandability is lowered. In order to prevent such fractures, the number density of martensite having an average diameter of 3 μm or more is set to 5.0 pieces/10000 $\mu m^2$ or less.

(Pearlite: Less than 3.0%)

Pearlite deteriorates the hole expandability and thus it is preferable that pearlite is not present. However, when the area fraction of pearlite is less than 3.0%, there is no actual damage to the steel and thus this value is allowable as an upper limit.

(Another Structure)

As for another structure, bainite may be present. Bainite is not essential and the area fraction of bainite may be 0%. Bainite is a structure contributing to increasing the strength. However, when a large amount of bainite is used to increase the strength, it is difficult to secure the above-mentioned area fraction of ferrite and high elongation cannot be achieved.

The tensile strength of the hot-rolled steel sheet of the present invention is preferably 590 MPa or more. The tensile strength is more preferably 630 MPa or more and particularly preferably 740 MPa or more.

Hereinafter, a method for producing the hot-rolled steel sheet according to the present invention will be described.

First, a slab is prepared by melting steel by a routine procedure and casting the steel, and blooming the steel according to the circumstances. As for the casting, continuous casting is preferable from the viewpoint of productivity.

The slab having the above-described chemical composition is heated to 1150° C. to 1300° C. and then subjected to multipass rough rolling. When the temperature of the slab to be subjected to rough rolling is lower than 1150° C., the rolling load is significantly increased during rough rolling and thus the productivity is deteriorated. Therefore, the temperature of the slab to be subjected to rough rolling is set to 1150° C. or higher. On the other hand, it is not preferable that the temperature of the slab to be subjected to rough rolling is higher than 1300° C. from the viewpoint of production costs. Accordingly, the temperature of the slab to be subjected to rough rolling is set to 1300° C. or lower. As for the slab to be subjected to rough rolling, a cast slab may be subjected to direct rolling as being hot-rolled. In order to obtain an effect of increasing the strength by precipitation strengthening, it is necessary to melt elements such as Nb and Ti. Thus, the temperature of the slab to be subjected to rough rolling is preferably 1200° C. or higher.

The above-described slab is subjected to multipass rough rolling and is rolled with four or more final passes of rolling at a temperature range of 1000° C. to 1050° C. for a total reduction of 30% or more to form a rough bar.

It is important to refine austenite in a hot rolling process to suppress formation of rough martensite. In order to refine austenite, it is effective to repeatedly recrystallize austenite in a rough rolling process before finish rolling. Here, the grains after recrystallization grow fast during rolling in a temperature range of higher than 1050° C. and thus it is difficult to refine austenite. On the other hand, since the grains are not completely recrystallized during rolling in a temperature range of lower than 1000° C. and then subjected to the following rolling, the grain diameter is not uniform in an uncrystallized portion and a recrystallized portion. As a result, the number density of martensite having an average diameter of 3 μm or more is increased. In addition, when the total reduction is less than 30%, austenite cannot be sufficiently refined. Further, even when rolling is performed for a total reduction of 30% or more, with less than four rolling passes, the grain diameter of austenite is not uniform and as a result, coarse martensite is formed.

Accordingly, the above-described slab is rolled by multipass rough rolling with four or more final passes of rolling in a temperature range of 1000° C. to 1050° C. for a total reduction of 30% or more to form a rough bar.

The above-mentioned rough bar is subjected to finish rolling in which rolling is completed in a temperature range of 850° C. to 950° C. while rolling is started within 60 seconds after the rough rolling is completed, and thus a finish-rolled steel sheet is obtained.

As described above, it is important to refine austenite in a hot rolling process to suppress formation of rough martensite. Even when the above described rough rolling is performed and the time from the start of finish rolling after completion of rough rolling is more than 60 seconds, the austenite is coarsened. Accordingly, the time from the start of finish rolling after the completion of rough rolling is within 60 seconds.

When the finishing temperature is higher than 950° C., the austenite after the finish rolling is completed is coarsened and thus the nucleation site of ferrite transformation is reduced to remarkably delay ferrite transformation. Accordingly, the finishing temperature is set to 950° C. or lower. On the other hand, when the finishing temperature is lower than 850° C., the rolling load increases. Therefore, the finishing temperature is set to 850° C. or higher.

Then, the finish-rolled steel sheet is subjected to primary cooling and air-cooled, and further subjected to secondary cooling and coiled. The primary cooling rate is set to an average cooling rate of 50° C./s or more. When the primary cooling rate is low, the grain diameter of ferrite is coarsened. Martensite is obtained by transformation of residual austenite in which ferrite transformation proceeds. When the grain diameter of ferrite is coarsened, the residual martensite is also coarsened. The upper limit of the primary cooling rate is not particularly limited. When the primary cooling rate is more than 100° C./s, excessive facility costs are required and thus a primary cooling rate of more than 100° C./s is not preferable.

The primary cooling stop temperature is set to 600° C. to 750° C. When the primary cooling stop temperature is lower than 600° C., ferrite transformation cannot sufficiently proceed during air-cooling. In addition, when the primary cooling stop temperature is higher than 750° C., ferrite transformation excessively proceeds and pearlite transformation occurs during the following cooling. Therefore, the hole expandability is deteriorated.

The air cooling time is set to 5 seconds to 10 seconds. When the air cooling time is shorter than 5 seconds, ferrite transformation cannot sufficiently proceed. In addition, when the air cooling time is longer than 10 seconds, pearlite transformation occurs and thus the hole expandability is deteriorated.

The secondary cooling rate is set to an average cooling rate of 30° C./s or more. When the secondary cooling rate is less than 30° C./s, bainite transformation excessively proceeds during cooling and a sufficient area fraction of ferrite cannot be obtained. Thus, uniform elongation is deteriorated. The upper limit thereof is not particularly limited. When the secondary cooling rate is more than 100° C./s, excessive facility costs are required and thus a secondary cooling rate of more than 100° C./s is not preferable.

The coiling temperature is set to 400° C. or lower. When the coiling temperature is higher than 400° C., bainite transformation excessively proceeds and a sufficient amount of martensite cannot be obtained. Thus, highly uniform elongation cannot be secured. The temperature range is preferably 250° C. or lower and more preferably 100° C. or lower, and the temperature may be room temperature.

EXAMPLES

Steels A to AJ having chemical compositions shown in Tables 1 and 2 as Examples 1 to 48 were melted and cast to obtain slabs. The slabs were rolled under the conditions shown in Tables 3 and 4.

TABLE 1

| Steel No. | Chemical composition (unit: mass %, remainder: Fe and impurities) | | | | | | | | | | | | | | | | | | |
|---|---|---|---|---|---|---|---|---|---|---|---|---|---|---|---|---|---|---|---|
| | C | Mn | Si | Al | Si + Al | P | S | N | Nb | Ti | V | W | Mo | Cr | Cu | Ni | B | REM | Ca |
| A | 0.052 | 2.60 | 0.70 | 0.090 | 0.790 | 0.016 | 0.0040 | 0.0020 | 0.059 | 0.060 | — | — | — | — | — | — | — | — | — |
| B | 0.060 | 1.90 | 0.90 | 0.200 | 1.100 | 0.023 | 0.0032 | 0.0036 | 0.065 | 0.150 | — | — | — | — | — | — | — | — | — |
| C | 0.060 | 1.10 | 1.00 | 0.250 | 1.250 | 0.032 | 0.0039 | 0.0035 | — | — | — | — | — | — | — | — | — | — | — |
| D | 0.045 | 1.60 | 1.90 | 0.150 | 2.050 | 0.018 | 0.0036 | 0.0028 | 0.007 | 0.103 | — | — | — | — | — | — | — | — | — |
| E | 0.057 | 0.98 | 0.50 | 0.300 | 0.800 | 0.014 | 0.0044 | 0.0038 | 0.009 | 0.130 | — | — | 0.35 | — | — | — | — | — | — |
| F | 0.051 | 0.60 | 0.77 | 0.110 | 0.880 | 0.005 | 0.0043 | 0.0022 | 0.040 | 0.088 | — | — | — | — | — | — | 0.0005 | — | — |
| G1 | 0.066 | 1.30 | 0.90 | 0.280 | 1.180 | 0.022 | 0.0056 | 0.0027 | 0.016 | 0.160 | — | — | — | — | — | — | — | — | — |
| G2 | 0.066 | 1.30 | 0.90 | 0.020 | 0.920 | 0.017 | 0.0056 | 0.0027 | 0.016 | 0.160 | — | — | — | — | — | — | — | — | — |
| G3 | 0.066 | 1.30 | 0.90 | 0.250 | 1.150 | 0.012 | 0.0056 | 0.0027 | 0.016 | 0.160 | — | — | — | — | — | — | — | — | — |
| G4 | 0.066 | 1.30 | 0.90 | 0.220 | 1.120 | 0.023 | 0.0056 | 0.0027 | 0.016 | 0.160 | — | — | — | — | — | — | — | — | — |
| G5 | 0.066 | 1.30 | 0.90 | 0.030 | 0.930 | 0.024 | 0.0056 | 0.0027 | 0.016 | 0.160 | — | — | — | — | — | — | — | — | — |
| G6 | 0.066 | 1.30 | 0.90 | 0.110 | 1.010 | 0.026 | 0.0056 | 0.0027 | 0.016 | 0.160 | — | — | — | — | — | — | — | — | — |
| G7 | 0.066 | 1.30 | 0.90 | 0.030 | 0.930 | 0.040 | 0.0056 | 0.0027 | 0.016 | 0.160 | — | — | — | — | — | — | — | — | — |
| G8 | 0.066 | 1.30 | 0.90 | 0.280 | 1.180 | 0.011 | 0.0056 | 0.0027 | 0.016 | 0.160 | — | — | — | — | — | — | — | — | — |
| G9 | 0.066 | 1.30 | 0.90 | 0.160 | 1.060 | 0.014 | 0.0056 | 0.0027 | 0.016 | 0.160 | — | — | — | — | — | — | — | — | — |
| H | 0.038 | 2.40 | 1.31 | 0.140 | 1.450 | 0.035 | 0.0032 | 0.0024 | 0.022 | 0.068 | — | — | — | — | — | — | — | — | — |
| I | 0.108 | 1.70 | 1.50 | 0.010 | 1.510 | 0.008 | 0.0031 | 0.0037 | 0.038 | 0.060 | — | — | — | — | — | — | — | — | — |
| J | 0.059 | 1.30 | 1.60 | 0.020 | 1.620 | 0.035 | 0.0051 | 0.0035 | 0.010 | 0.146 | — | — | — | — | — | — | — | — | — |
| K | 0.062 | 0.90 | 1.28 | 0.050 | 1.330 | 0.038 | 0.0036 | 0.0029 | 0.020 | 0.120 | — | — | — | — | — | — | — | — | — |
| L | 0.056 | 1.00 | 0.90 | 0.210 | 1.110 | 0.015 | 0.0039 | 0.0037 | 0.004 | 0.190 | — | — | — | — | — | — | — | — | — |
| M | 0.059 | 1.40 | 0.90 | 0.040 | 0.940 | 0.038 | 0.0031 | 0.0026 | 0.057 | 0.010 | — | — | — | — | — | — | — | — | — |
| N | 0.045 | 1.30 | 0.60 | 0.290 | 0.890 | 0.037 | 0.0040 | 0.0026 | 0.009 | 0.157 | — | — | — | — | — | — | — | — | — |
| O | 0.054 | 0.70 | 0.08 | 0.015 | 0.095 | 0.014 | 0.0052 | 0.0038 | 0.029 | 0.150 | — | — | — | — | — | — | — | — | — |
| P | 0.060 | 0.90 | 0.52 | 0.020 | 0.540 | 0.031 | 0.0039 | 0.0030 | 0.019 | 0.142 | — | — | — | — | — | — | — | — | — |

TABLE 2

| Steel No. | Chemical composition (unit: mass %, remainder: Fe and impurities) | | | | | | | | | | | | | | | | | | |
|---|---|---|---|---|---|---|---|---|---|---|---|---|---|---|---|---|---|---|---|
| | C | Mn | Si | Al | Si + Al | P | S | N | Nb | Ti | V | W | Mo | Cr | Cu | Ni | B | REM | Ca |
| Q | 0.090 | 1.50 | 1.47 | 0.050 | 1.520 | 0.023 | 0.0036 | 0.0029 | 0.013 | 0.135 | — | — | — | — | — | — | — | — | — |
| R | 0.036 | 0.90 | 1.38 | 0.020 | 1.400 | 0.027 | 0.0055 | 0.0040 | 0.020 | 0.100 | — | 0.3 | — | — | — | — | — | — | — |
| S | 0.070 | 1.00 | 0.30 | 0.220 | 0.520 | 0.024 | 0.0036 | 0.0035 | 0.024 | 0.070 | — | — | — | — | — | — | — | — | — |
| T | 0.048 | 1.60 | 0.30 | 0.110 | 0.410 | 0.033 | 0.0040 | 0.0030 | 0.055 | 0.100 | — | — | — | — | — | — | — | — | — |
| U | 0.047 | 1.10 | 0.60 | 0.170 | 0.770 | 0.029 | 0.0035 | 0.0039 | 0.021 | 0.210 | — | — | — | — | — | — | — | — | — |
| V | 0.072 | 0.86 | 1.18 | 0.280 | 1.460 | 0.008 | 0.0033 | 0.0021 | 0.020 | 0.065 | — | — | — | — | — | — | — | 0.001 | — |
| W1 | 0.055 | 1.30 | 1.20 | 0.180 | 1.380 | 0.009 | 0.0035 | 0.0020 | 0.032 | 0.120 | — | — | — | — | — | — | — | — | — |
| W2 | 0.055 | 1.30 | 1.20 | 0.220 | 1.420 | 0.026 | 0.0035 | 0.0020 | 0.032 | 0.120 | — | — | — | — | — | — | — | — | — |
| W3 | 0.055 | 1.30 | 1.20 | 0.270 | 1.470 | 0.031 | 0.0035 | 0.0020 | 0.032 | 0.120 | — | — | — | — | — | — | — | — | — |
| W4 | 0.055 | 1.30 | 1.20 | 0.170 | 1.370 | 0.030 | 0.0035 | 0.0020 | 0.032 | 0.120 | — | — | — | — | — | — | — | — | — |
| W5 | 0.055 | 1.30 | 1.20 | 0.150 | 1.350 | 0.028 | 0.0035 | 0.0020 | 0.032 | 0.120 | — | — | — | — | — | — | — | — | — |
| W6 | 0.055 | 1.30 | 1.20 | 0.290 | 1.490 | 0.039 | 0.0035 | 0.0020 | 0.032 | 0.120 | — | — | — | — | — | — | — | — | — |
| X | 0.077 | 2.10 | 1.44 | 0.170 | 1.610 | 0.038 | 0.0048 | 0.0039 | 0.041 | 0.030 | — | — | — | — | — | — | 0.001 | — | — |
| Y | 0.028 | 0.70 | 0.80 | 0.020 | 0.820 | 0.009 | 0.0051 | 0.0032 | 0.013 | 0.130 | — | — | — | — | — | — | — | — | — |
| Z | 0.051 | 0.79 | 1.14 | 0.100 | 1.240 | 0.012 | 0.0032 | 0.0023 | 0.020 | 0.190 | — | — | — | — | — | — | — | — | — |
| AA | 0.052 | 1.22 | 0.65 | 0.300 | 0.950 | 0.032 | 0.0057 | 0.0021 | 0.027 | 0.130 | 0.1 | — | — | — | — | — | — | — | — |
| AC | 0.066 | 0.40 | 0.70 | 0.170 | 0.870 | 0.034 | 0.0050 | 0.0028 | 0.047 | 0.040 | — | — | — | — | — | — | — | — | — |
| AD | 0.095 | 1.10 | 1.25 | 0.110 | 1.360 | 0.020 | 0.0051 | 0.0023 | 0.011 | 0.100 | — | — | — | — | — | — | — | — | 0.001 |
| AE | 0.061 | 1.25 | 1.24 | 0.170 | 1.410 | 0.018 | 0.0036 | 0.0028 | 0.013 | — | 0.15 | — | 0.06 | — | — | — | — | — | — |
| AF | 0.060 | 1.03 | 1.24 | 0.140 | 1.380 | 0.038 | 0.0035 | 0.0020 | — | 0.110 | 0.07 | 0.2 | 0.12 | — | — | — | — | — | — |
| AG | 0.060 | 1.02 | 1.24 | 0.250 | 1.490 | 0.032 | 0.0056 | 0.0027 | 0.018 | 0.120 | 0.1 | — | — | — | 0.3 | — | — | — | — |
| AH | 0.059 | 1.45 | 1.16 | 0.080 | 1.240 | 0.014 | 0.0051 | 0.0035 | 0.016 | 0.130 | — | — | 0.3 | — | — | 0.1 | — | — | — |
| AI | 0.060 | 1.45 | 1.14 | 0.190 | 1.330 | 0.015 | 0.0036 | 0.0028 | 0.021 | 0.130 | 0.18 | — | — | 0.2 | — | — | — | — | — |
| AJ | 0.061 | 1.30 | 1.07 | 0.190 | 1.260 | 0.006 | 0.0044 | 0.0038 | 0.020 | 0.140 | 0.03 | — | — | 0.1 | — | 0.2 | — | 0.001 | 0.001 |

TABLE 3

| Unit | Hot rolling conditions | | | | | | | | | | |
|---|---|---|---|---|---|---|---|---|---|---|---|
| | Steel No. — | Heating temperature ° C. | Number of reductions at 1000° C. to 1050° C. — | Total reduction at 1000° C. to 1050° C. % | Time between rough rolling and finish rolling Seconds | Finishing temperature ° C. | Primary cooling rate ° C./sec | Primary cooling stop temperature ° C. | Air cooling time Seconds | Secondary cooling rate ° C./sec | Coiling temperature ° C. |
| Example 1 | A | 1250 | 5 | 45 | 56 | 922 | 55 | 681 | 9 | 39 | 124 |
| Example 2 | B | 1250 | 4 | 37 | 33 | 908 | 55 | 727 | 8 | 31 | 287 |
| Example 3 | C | 1200 | 5 | 32 | 39 | 939 | 65 | 700 | 8 | 32 | 223 |
| Example 4 | D | 1220 | 4 | 38 | 55 | 896 | 60 | 738 | 7 | 33 | 390 |
| Example 5 | E | 1220 | 4 | 40 | 46 | 945 | 55 | 688 | 9 | 36 | 220 |

TABLE 3-continued

| Unit | Steel No. — | Heating temperature ° C. | Number of reductions at 1000° C. to 1050° C. — | Total reduction at 1000° C. to 1050° C. % | Time between rough rolling and finish rolling Seconds | Finishing temperature ° C. | Primary cooling rate ° C./sec | Primary cooling stop temperature ° C. | Air cooling time Seconds | Secondary cooling rate ° C./sec | Coiling temperature ° C. |
|---|---|---|---|---|---|---|---|---|---|---|---|
| | Hot rolling conditions | | | | | | | | | | |
| Example 6 | F | 1220 | 5 | 33 | 43 | 921 | 55 | 737 | 7 | 44 | 390 |
| Example 7 | G1 | 1240 | 4 | 40 | 37 | 920 | 65 | 718 | 5 | 32 | 274 |
| Example 8 | G2 | 1140 | 5 | 32 | 36 | 869 | 60 | 617 | 7 | 31 | 225 |
| Example 9 | G3 | 1220 | 5 | 42 | 36 | 898 | 60 | 630 | 11 | 42 | 118 |
| Example 10 | G4 | 1240 | 5 | 38 | 47 | 961 | 65 | 688 | 8 | 45 | 208 |
| Example 11 | G5 | 1250 | 5 | 48 | 35 | 939 | 55 | 644 | 4 | 34 | 228 |
| Example 12 | G6 | 1250 | 5 | 33 | 33 | 941 | 45 | 717 | 7 | 38 | 144 |
| Example 13 | G7 | 1220 | 3 | 34 | 47 | 893 | 65 | 616 | 6 | 45 | 171 |
| Example 14 | G8 | 1260 | 5 | 28 | 35 | 890 | 60 | 664 | 5 | 41 | 290 |
| Example 15 | G9 | 1240 | 5 | 34 | 64 | 887 | 55 | 678 | 6 | 35 | 230 |
| Example 16 | H | 1210 | 5 | 40 | 51 | 896 | 55 | 704 | 8 | 42 | 58 |
| Example 17 | I | 1280 | 5 | 47 | 52 | 944 | 60 | 612 | 7 | 33 | 86 |
| Example 18 | J | 1230 | 5 | 33 | 41 | 896 | 55 | 658 | 7 | 37 | 240 |
| Example 19 | K | 1250 | 5 | 41 | 40 | 928 | 60 | 606 | 5 | 45 | 164 |
| Example 20 | L | 1280 | 2 | 50 | 47 | 897 | 55 | 720 | 9 | 41 | 248 |
| Example 21 | M | 1270 | 4 | 46 | 42 | 930 | 60 | 628 | 8 | 38 | 253 |
| Example 22 | N | 1220 | 4 | 41 | 50 | 934 | 65 | 660 | 5 | 45 | 56 |
| Example 23 | O | 1210 | 4 | 47 | 48 | 931 | 65 | 632 | 8 | 33 | 264 |
| Example 24 | P | 1270 | 5 | 39 | 36 | 899 | 55 | 720 | 6 | 42 | 74 |

TABLE 4

| Unit | Steel No. — | Heating temperature ° C. | Number of reductions at 1000° C. to 1050° C. — | Total reduction at 1000° C. to 1050° C. % | Time between rough rolling and finish rolling Seconds | Finishing temperature ° C. | Primary cooling rate ° C./sec | Primary cooling stop temperature ° C. | Air cooling time Seconds | Secondary cooling rate ° C./sec | Coiling temperature ° C. |
|---|---|---|---|---|---|---|---|---|---|---|---|
| | Hot rolling conditions | | | | | | | | | | |
| Example 25 | Q | 1240 | 5 | 39 | 55 | 947 | 35 | 628 | 9 | 38 | 280 |
| Example 26 | R | 1270 | 4 | 50 | 52 | 920 | 60 | 710 | 9 | 37 | 154 |
| Example 27 | S | 1210 | 4 | 35 | 50 | 926 | 65 | 632 | 6 | 39 | 159 |
| Example 28 | T | 1280 | 4 | 47 | 55 | 881 | 55 | 695 | 7 | 33 | 152 |
| Example 29 | U | 1220 | 4 | 47 | 56 | 889 | 55 | 625 | 5 | 38 | 207 |
| Example 30 | V | 1220 | 5 | 49 | 43 | 932 | 60 | 609 | 8 | 41 | 129 |
| Example 31 | W1 | 1210 | 4 | 40 | 49 | 918 | 55 | 697 | 7 | 32 | 95 |
| Example 32 | W2 | 1240 | 4 | 41 | 43 | 938 | 55 | 717 | 6 | 40 | 116 |
| Example 33 | W3 | 1230 | 4 | 32 | 45 | 900 | 55 | 760 | 5 | 38 | 206 |
| Example 34 | W4 | 1270 | 4 | 44 | 50 | 924 | 60 | 718 | 8 | 35 | 430 |
| Example 35 | W5 | 1270 | 4 | 33 | 35 | 938 | 65 | 590 | 9 | 32 | 119 |
| Example 36 | W6 | 1240 | 4 | 32 | 48 | 892 | 60 | 722 | 6 | 26 | 180 |
| Example 37 | X | 1260 | 4 | 39 | 46 | 903 | 55 | 737 | 8 | 36 | 178 |
| Example 38 | Y | 1280 | 4 | 40 | 31 | 878 | 65 | 614 | 8 | 34 | 284 |
| Example 39 | Z | 1240 | 4 | 46 | 38 | 925 | 55 | 669 | 6 | 39 | 121 |
| Example 40 | AA | 1210 | 4 | 36 | 54 | 923 | 65 | 627 | 7 | 39 | 77 |
| Example 41 | AC | 1280 | 4 | 50 | 35 | 880 | 65 | 630 | 6 | 40 | 299 |
| Example 42 | AD | 1230 | 5 | 43 | 58 | 949 | 60 | 626 | 6 | 35 | 275 |
| Example 43 | AE | 1210 | 4 | 45 | 32 | 920 | 55 | 703 | 7 | 35 | 131 |
| Example 44 | AF | 1210 | 4 | 45 | 43 | 920 | 55 | 693 | 7 | 35 | 139 |
| Example 45 | AG | 1210 | 4 | 45 | 44 | 920 | 55 | 706 | 7 | 35 | 127 |
| Example 46 | AH | 1210 | 4 | 45 | 39 | 920 | 55 | 702 | 7 | 35 | 122 |
| Example 47 | AI | 1210 | 4 | 45 | 49 | 920 | 55 | 692 | 7 | 35 | 129 |
| Example 48 | AJ | 1210 | 4 | 45 | 60 | 920 | 55 | 707 | 7 | 35 | 143 |

A sample was collected from each of the obtained steel sheets and the metallographic structure was observed at a position which was at ¼ of the steel sheet thickness using an optical microscope. For preparation of the sample, the cross section of the steel sheet thickness in a rolling direction was polished as a surface to be observed and was etched with a nital reagent and a Le Pera reagent. The image of the sample etched with a nital reagent which was obtained by observation through an optical microscope at 500 times was analyzed to obtain area fractions of ferrite and pearlite. In addition, the image of the sample etched with a Le Pera reagent which was obtained by observation through an optical microscope at 500 times was analyzed to obtain an area fraction and the average diameter of the martensite. The average diameter is obtained by number-averaging the equivalent circle diameter of each of the grains of martensite. A martensite grain of less than 1.0 μm was excluded from number counting. The area fraction of bainite was obtained as the remainder of ferrite, pearlite and martensite.

The tensile strength (TS) was evaluated according to JIS Z 2241:2011 using a No. 5 test piece described in JIS Z 2201:1998 collected from each steel sheet at a position, which was at ¼ in the steel sheet width direction, in a direction perpendicular to the rolling direction. The uniform elongation (u-El) and total elongation (t-El) were measured together with the tensile strength (TS). A hole expanding test was performed according to a test method described in Japan Iron and Steel Federation Standard JFS T1001-1996 to evaluate hole expandability (λ). The structures and mechanical properties of the steel sheets were shown in Tables 5 and 6. In Tables 5 and 6, $V_F$ represents the area fraction (%) of ferrite, $V_B$ represents the area fraction (%) of bainite, $V_P$ represents the area fraction (%) of pearlite, and $V_M$ represents the area fraction (%) of martensite, respectively. $D_M$ represents a martensite average diameter (μm) and $N_M$ represents the number density of martensite having an equivalent circle diameter of 3 μm or more per 10000 $\mu m^2$ at a position which is at a depth of ¼ of the steel sheet thickness from the surface of the steel sheet.

TABLE 5

| | | Evaluation results | | | | | | | | | | |
|---|---|---|---|---|---|---|---|---|---|---|---|---|
| | | Microstructure | | | | | | | Mechanical properties | | | |
| Unit | Steel No. — | $V_F$ % | $V_B$ % | $V_P$ % | $V_M$ % | $D_M$ μm | $N_M$ /10000 $\mu m^2$ | $R/D_M^2$ — | TS MPa | u-El % | t-El % | λ % | Remarks |
| Example 1 | A | 79.3 | 9.5 | 0 | 11.2 | 1.49 | 3.6 | 1.27 | 805 | 7.6 | 16.7 | 83 | Comparative Example |
| Example 2 | B | 79.1 | 7.8 | 0 | 13.1 | 1.29 | 4.4 | 1.30 | 783 | 8.5 | 17.2 | 84 | Comparative Example |
| Example 3 | C | 91.2 | 3.0 | 1.3 | 4.5 | 1.79 | 2.8 | 1.93 | 633 | 21.2 | 34.5 | 138 | Example |
| Example 4 | D | 93.4 | 1.5 | 0 | 5.1 | 1.78 | 3.7 | 1.79 | 817 | 12.4 | 22.7 | 111 | Example |
| Example 5 | E | 91.0 | 2.1 | 0 | 6.9 | 2.30 | 3.8 | 1.14 | 786 | 11.8 | 21.3 | 83 | Example |
| Example 6 | F | 92.2 | 1.4 | 0 | 6.4 | 1.49 | 4.5 | 1.85 | 830 | 11.7 | 21.9 | 111 | Example |
| Example 7 | G1 | 95.2 | 0 | 0 | 4.8 | 1.88 | 4.2 | 1.76 | 824 | 12.5 | 24.5 | 121 | Example |
| Example 8 | G2 | 96.5 | 0 | 0 | 3.5 | 1.89 | 4.8 | 2.13 | 743 | 15.4 | 24.6 | 132 | Example |
| Example 9 | G3 | 95.7 | 0 | 3.7 | 0.6 | 2.07 | 1.2 | 5.25 | 760 | 12.5 | 24.9 | 71 | Comparative Example |
| Example 10 | G4 | 78.2 | 8.6 | 1.7 | 11.5 | 1.50 | 4.2 | 1.23 | 833 | 8.5 | 19.3 | 82 | Comparative Example |
| Example 11 | G5 | 77.7 | 9.7 | 2.2 | 10.4 | 1.63 | 3.4 | 1.22 | 839 | 8.3 | 19.1 | 83 | Comparative Example |
| Example 12 | G6 | 89.3 | 1.7 | 0 | 9.0 | 2.50 | 4.6 | 0.88 | 825 | 14.5 | 23.1 | 69 | Comparative Example |
| Example 13 | G7 | 94.9 | 0 | 0 | 5.1 | 2.49 | 5.3 | 1.28 | 800 | 11.9 | 21.3 | 76 | Comparative Example |
| Example 14 | G8 | 95.2 | 1.3 | 0 | 3.5 | 4.20 | 4.9 | 0.96 | 814 | 12.5 | 20.7 | 74 | Comparative Example |
| Example 15 | G9 | 92.3 | 0 | 0 | 7.7 | 3.45 | 3.5 | 0.71 | 822 | 13.1 | 24.7 | 60 | Comparative Example |
| Example 16 | H | 96.0 | 0 | 0 | 4.0 | 3.24 | 3.9 | 1.14 | 831 | 11.9 | 21.4 | 89 | Example |
| Example 17 | I | 83.4 | 1.2 | 0 | 15.4 | 1.66 | 3.3 | 0.90 | 817 | 11.5 | 24.0 | 70 | Comparative Example |
| Example 18 | J | 92.8 | 1.5 | 0 | 5.7 | 2.41 | 4.9 | 1.23 | 789 | 12.5 | 24.5 | 92 | Example |
| Example 19 | K | 94.3 | 0 | 0 | 5.7 | 2.01 | 3.9 | 1.48 | 807 | 12.3 | 21.5 | 100 | Example |
| Example 20 | L | 95.9 | 0 | 0 | 4.1 | 2.05 | 6.1 | 1.78 | 759 | 13.4 | 20.9 | 67 | Comparative Example |
| Example 21 | M | 93.5 | 0.5 | 0 | 6.0 | 1.56 | 3.5 | 1.84 | 771 | 13.5 | 22.5 | 135 | Example |
| Example 22 | N | 94.4 | 1.3 | 0 | 4.3 | 3.11 | 4.1 | 1.14 | 814 | 12.8 | 20.2 | 84 | Example |
| Example 23 | O | 79.3 | 9.8 | 2.7 | 8.2 | 2.06 | 3.4 | 1.14 | 807 | 8.9 | 17.0 | 83 | Comparative Example |
| Example 24 | P | 95.6 | 0.6 | 0 | 3.8 | 3.05 | 4.1 | 1.25 | 809 | 13.5 | 21.9 | 95 | Example |

TABLE 6

| | | Evaluation results | | | | | | | | | | |
|---|---|---|---|---|---|---|---|---|---|---|---|---|
| | | Microstructure | | | | | | | Mechanical properties | | | |
| Unit | Steel No. — | $V_F$ % | $V_B$ % | $V_P$ % | $V_M$ % | $D_M$ μm | $N_M$ /10000 $\mu m^2$ | $R/D_M^2$ — | TS MPa | u-El % | t-El % | λ % | Remarks |
| Example 25 | Q | 90.2 | 4.5 | 0 | 5.3 | 3.41 | 4.0 | 0.91 | 790 | 11.6 | 24.0 | 78 | Comparative Example |
| Example 26 | R | 95.6 | 0 | 0 | 4.4 | 2.20 | 2.9 | 1.59 | 817 | 11.5 | 24.1 | 121 | Example |
| Example 27 | S | 92.6 | 1.0 | 0 | 6.4 | 2.04 | 4.4 | 1.35 | 782 | 11.7 | 20.0 | 95 | Example |
| Example 28 | T | 95.4 | 0 | 0 | 4.6 | 2.35 | 3.3 | 1.45 | 791 | 12.1 | 20.7 | 105 | Example |
| Example 29 | U | 95.7 | 0 | 0 | 4.3 | 2.07 | 3.3 | 1.72 | 847 | 7.8 | 16.5 | 121 | Comparative Example |
| Example 30 | V | 91.5 | 2.0 | 0 | 6.5 | 2.10 | 2.9 | 1.30 | 831 | 11.8 | 24.7 | 91 | Example |
| Example 31 | W1 | 93.8 | 0 | 0 | 6.2 | 1.98 | 4.0 | 1.42 | 797 | 13 | 20.4 | 95 | Example |
| Example 32 | W2 | 93.6 | 0 | 0 | 6.4 | 1.99 | 3.7 | 1.39 | 820 | 13.5 | 22.1 | 90 | Example |
| Example 33 | W3 | 92.2 | 0 | 3.3 | 4.5 | 2.53 | 4.8 | 1.36 | 759 | 14 | 23.8 | 73 | Comparative Example |
| Example 34 | W4 | 92.8 | 5.2 | 0 | 2.0 | 2.30 | 3.6 | 2.43 | 756 | 9.5 | 19.4 | 149 | Comparative Example |
| Example 35 | W5 | 79.3 | 9.1 | 2.4 | 9.2 | 1.87 | 4.6 | 1.16 | 830 | 7.8 | 16.6 | 82 | Comparative Example |
| Example 36 | W6 | 79.0 | 15.3 | 0 | 5.7 | 2.46 | 4.8 | 1.21 | 739 | 9.3 | 18.7 | 96 | Comparative Example |
| Example 37 | X | 93.7 | 0 | 0 | 6.3 | 2.60 | 4.1 | 1.07 | 793 | 12 | 21.8 | 87 | Example |
| Example 38 | Y | 98.1 | 0.7 | 0 | 1.2 | 2.07 | 2.9 | 3.60 | 748 | 9.1 | 17.6 | 147 | Comparative Example |
| Example 39 | Z | 94.2 | 1.1 | 0 | 4.7 | 2.17 | 3.5 | 1.55 | 791 | 12.2 | 21.6 | 111 | Example |
| Example 40 | AA | 96.2 | 0 | 0 | 3.8 | 3.40 | 4.6 | 1.12 | 835 | 12.2 | 21.9 | 89 | Example |
| Example 41 | AC | 96.7 | 0 | 3.3 | 0 | — | — | — | 767 | 8.9 | 18.8 | 118 | Comparative Example |
| Example 42 | AD | 87.5 | 2.5 | 0 | 10.0 | 1.65 | 3.9 | 1.24 | 792 | 12.7 | 21.7 | 85 | Example |
| Example 43 | AE | 91 | 0 | 0 | 9 | 1.77 | 3.3 | 1.24 | 803 | 13.1 | 21.2 | 86 | Example |
| Example 44 | AF | 93 | 0 | 0 | 7 | 2.01 | 3.3 | 1.29 | 792 | 12.8 | 21.6 | 90 | Example |
| Example 45 | AG | 90.4 | 0 | 0 | 9.6 | 1.64 | 2.9 | 1.28 | 794 | 12.7 | 20.9 | 84 | Example |

TABLE 6-continued

| | | Evaluation results | | | | | | | | | | | |
|---|---|---|---|---|---|---|---|---|---|---|---|---|---|
| | | Microstructure | | | | | | | Mechanical properties | | | | |
| Unit | Steel No. — | $V_F$ % | $V_B$ % | $V_P$ % | $V_M$ % | $D_M$ μm | $N_M$ /10000 μm$^2$ | $R/D_M^2$ — | TS MPa | u-El % | t-El % | λ % | Remarks |
| Example 46 | AH | 91.1 | 0 | 0 | 8.9 | 1.74 | 4.0 | 1.27 | 784 | 12.9 | 23.8 | 85 | Example |
| Example 47 | AI | 92 | 0 | 0 | 8 | 1.55 | 3.7 | 1.54 | 811 | 12.8 | 20.5 | 90 | Example |
| Example 48 | AJ | 92 | 0 | 0 | 8 | 1.76 | 4.8 | 1.35 | 808 | 12.5 | 23.7 | 90 | Example |

The results will be described. Examples 3 to 8, 16, 18, 19, 21, 22, 24, 26 to 28, 30 to 32, 37, 39, 40, and 42 to 48 are examples of the present invention. In these examples, the chemical compositions of steel components, production conditions and microstructures satisfied the requirements of the present invention and both the elongation and hole expandability were excellent. On the other hand, Examples 1, 2, 9 to 15, 17, 20, 23, 25, 29, 33 to 36, 38, and 41 are comparative examples. In these comparative examples, effects were not able to be obtained due to the reasons shown below.

In Example 1, since Steel No. A in which the amount of Mn was large was used, ferrite transformation did not sufficiently proceed. Therefore, the area fraction of ferrite was less than 80% and thus the uniform elongation was low.

In Example 2, since Steel No. B in which the amount of Nb was large was used, ferrite transformation did not sufficiently proceed. Therefore, the area fraction of ferrite was less than 80% and thus the uniform elongation was low.

In Example 9, since the air cooling time was too long, the formed pearlite exceeded an appropriate range. Therefore, the hole expandability was low.

In Example 10, since the finishing temperature was too high, ferrite transformation did not sufficiently proceed. Therefore, the area fraction of ferrite was less than 80% and thus the uniform elongation was low.

In Example 11, since the air cooling time was too short, ferrite transformation did not sufficiently proceed. Therefore, the area fraction of ferrite was less than 80% and thus the uniform elongation was low.

In Example 12, since the primary cooling rate was low, the average diameter of martensite was large and as a result, Expression 1 was not satisfied. Therefore, the hole expandability was low.

In Examples 13 and 20, since the number of rolling passes in a temperature range of 1000° C. to 1050° C. was small, the number density of coarse martensite was high. Therefore, the hole expandability was low.

In Example 14, since the reduction in a temperature range of 1000° C. to 1050° C. was low, the average diameter of martensite was large and as a result, Expression 1 was not satisfied. Therefore, the hole expandability was low.

In Example 15, since the time from the end of rough rolling to the start of finish rolling was long, austenite was coarsened and the average diameter of martensite was large. Therefore, $R/D_M^2$ was decreased and the hole expandability was low.

In Example 17, since Steel No. I in which the amount of C was large was used, the area fraction of martensite was high. Therefore, the hole expandability was low.

In Example 23, since Steel No. O in which the amount of Si+Al was small was used, ferrite transformation did not sufficiently proceed. Therefore, the uniform elongation was low.

In Example 25, since the primary cooling rate was low, the average diameter of martensite was large and as a result, Expression 1 was not satisfied. Therefore, the hole expandability was low.

In Example 29, since Steel No. U in which the amount of Ti was large was used, ferrite was excessively strengthened. Therefore, the uniform elongation was low.

In Example 33, since the primary cooling rate was high, pearlite was formed. Therefore, the hole expandability was low.

In Example 34, since the coiling temperature was too high, martensite was rarely formed. Therefore, the uniform elongation was low.

In Example 35, since the primary cooling stop temperature was too low, ferrite transformation did not sufficiently proceed. Therefore, the area fraction of ferrite was less than 80% and the uniform elongation was low.

In Example 36, since the secondary cooling rate was low, bainite was formed. Therefore, the area fraction of ferrite was less than 80% and the uniform elongation was low.

In Example 38, since Steel No. Yin which the amount of C was small was used, the area fraction of martensite was less than 3%. Therefore, the uniform elongation was low.

In Example 41, since Steel No. AC in which the amount of Mn was small was used, martensite was not formed. Therefore, the uniform elongation was low.

INDUSTRIAL APPLICABILITY

According to the present invention, it is possible to provide a high-strength hot-rolled steel sheet capable of attaining excellent elongation and hole expandability without containing an expensive element and a method for producing the same.

The invention claimed is:

1. A hot-rolled steel sheet comprising, as a chemical composition, by mass %:

C: 0.030% to 0.10%;
Mn: 0.5% to 2.5%;
Si+Al: 0.100% to 2.5%;
P: 0.04% or less;
S: 0.01% or less;
N: 0.01% or less;
Nb: 0% to 0.06%;
Ti: 0% to 0.20%;
V: 0% to 0.20%;
W: 0% to 0.5%;
Mo: 0% to 0.40%;
Cr: 0% to 1.0%;
Cu: 0% to 1.2%;
Ni: 0% to 0.6%;
B: 0% to 0.005%;
REM: 0% to 0.01%;
Ca: 0% to 0.01%; and
a remainder consisting of Fe and impurities, wherein the steel sheet has a microstructure including, by area fraction, ferrite: 80% or more and 87.5% or less, martensite: 3% to 15.0%, and pearlite: less than 3.0%, in which a number density of martensite having an equivalent circle diameter of 3 μm or more at a position which is at a depth of ¼ of the steel sheet thickness from the surface of the steel sheet, is 5.0 pieces/10000 $\mu m^2$ or less, and the following Expression (1) is satisfied, $$R/D_M^2 \geq 1.00 \quad \text{Expression (1)},$$

here, R is an average martensite interval (μm) defined by the following Expression (2), and $D_M$ is a martensite average diameter (μm), $$R=\{12.5\times(\pi/6V_M)^{0.5}-2/3)^{0.5}\}\times D_M \quad \text{Expression (2)},$$

here, $V_M$ is a martensite area fraction (%) and $D_M$ is the martensite average diameter (μm), and wherein the hot-rolled steel sheet has a tensile strength of 630 MPa or more.

2. A method for producing a hot-rolled steel sheet comprising:

heating a slab having the chemical composition according to claim 1, to 1150° C. to 1300° C., then subjecting the slab to multipass rough rolling and rolling the slab with four or more final passes of rolling in a temperature range of 1000° C. to 1050° C. at a total reduction of 30% or more to form a rough bar;

starting rolling on the rough bar 32 seconds to 60 seconds after completing the rough rolling and subjecting the rough bar to finish rolling to complete rolling in a temperature range of 850° C. to 950° C. to obtain a finish-rolled steel sheet; and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

3. The hot-rolled steel sheet according to claim 1, further comprising, as a chemical composition, by mass %, at least one of Nb: 0.005% to 0.06% and Ti: 0.02% to 0.20%.

4. A method for producing a hot-rolled steel sheet comprising:

heating a slab having the chemical composition according to claim 3, to 1150° C. to 1300° C., then subjecting the slab to multipass rough rolling and rolling the slab with four or more final passes of rolling in a temperature range of 1000° C. to 1050° C. at a total reduction of 30% or more to form a rough bar;

starting rolling on the rough bar 32 seconds to 60 seconds after completing the rough rolling and subjecting the rough bar to finish rolling to complete rolling in a temperature range of 850° C. to 950° C. to obtain a finish-rolled steel sheet; and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

5. The hot-rolled steel sheet according to claim 1, further comprising, as a chemical composition, by mass %, at least one of V: 0.02% to 0.20%, W: 0.1% to 0.5%, and Mo: 0.05% to 0.40%.

6. A method for producing a hot-rolled steel sheet comprising:

heating a slab having the chemical composition according to claim 5, to 1150° C. to 1300° C., then subjecting the slab to multipass rough rolling and rolling the slab with four or more final passes of rolling in a temperature range of 1000° C. to 1050° C. at a total reduction of 30% or more to form a rough bar;

starting rolling on the rough bar 32 seconds to 60 seconds after completing the rough rolling and subjecting the rough bar to finish rolling to complete rolling in a temperature range of 850° C. to 950° C. to obtain a finish-rolled steel sheet; and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

7. The hot-rolled steel sheet according to claim 1, further comprising, as a chemical composition, by mass %, at least one of Cr: 0.01% to 1.0%, Cu: 0.1% to 1.2%, Ni: 0.05% to 0.6%, and B: 0.0001% to 0.005%.

8. A method for producing a hot-rolled steel sheet comprising:

heating a slab having the chemical composition according to claim 7, to 1150° C. to 1300° C., then subjecting the slab to multipass rough rolling and rolling the slab with four or more final passes of rolling in a temperature range of 1000° C. to 1050° C. at a total reduction of 30% or more to form a rough bar;

starting rolling on the rough bar 32 seconds to 60 seconds after completing the rough rolling and subjecting the rough bar to finish rolling to complete rolling in a temperature range of 850° C. to 950° C. to obtain a finish-rolled steel sheet; and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

9. The hot-rolled steel sheet according to claim 1, further comprising, as a chemical composition, by mass %, at least one of REM: 0.0005% to 0.01% and Ca: 0.0005% to 0.01%.

10. A method for producing a hot-rolled steel sheet comprising:

heating a slab having the chemical composition according to claim 9, to 1150° C. to 1300° C., then subjecting the slab to multipass rough rolling and rolling the slab with four or more final passes of rolling in a temperature range of 1000° C. to 1050° C. at a total reduction of 30% or more to form a rough bar;

starting rolling on the rough bar 32 seconds to 60 seconds after completing the rough rolling and subjecting the rough bar to finish rolling to complete rolling in a temperature range of 850° C. to 950° C. to obtain a finish-rolled steel sheet; and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

11. The hot-rolled steel sheet according to claim 1, further comprising, as a chemical composition, by mass %, at least one of Nb: 0.005% to 0.06%, Ti: 0.02% to 0.20%, V: 0.02% to 0.20%, W: 0.1% to 0.5%, Mo: 0.05% to 0.40%, Cr: 0.01% to 1.0%, Cu: 0.1% to 1.2%, Ni: 0.05% to 0.6%, B: 0.0001% to 0.005%, REM: 0.0005% to 0.01%, and Ca: 0.0005% to 0.01%.

12. A method for producing a hot-rolled steel sheet comprising:

heating a slab having the chemical composition according to claim 11, to 1150° C. to 1300° C., then subjecting the slab to multipass rough rolling and rolling the slab with four or more final passes of rolling in a temperature range of 1000° C. to 1050° C. at a total reduction of 30% or more to form a rough bar;

starting rolling on the rough bar 32 seconds to 60 seconds after completing the rough rolling and subjecting the rough bar to finish rolling to complete rolling in a temperature range of 850° C. to 950° C. to obtain a finish-rolled steel sheet; and after cooling the finish-rolled steel sheet to a temperature range of 600° C. to 750° C. at an average cooling rate of 50° C./s or more and air-cooling the steel sheet for 5 seconds to 10 seconds, cooling the steel sheet to a temperature range of 400° C. or lower at an average cooling rate of 30° C./s or more and coiling the steel sheet to obtain a hot-rolled steel sheet.

13. A hot-rolled steel sheet comprising, as a chemical composition, by mass %:

C: 0.030% to 0.10%;
Mn: 0.5% to 2.5%;
Si+Al: 0.100% to 2.5%;
P: 0.04% or less;
S: 0.01% or less;
N: 0.01% or less;
Nb: 0% to 0.06%;
Ti: 0% to 0.20%;
V: 0% to 0.20%;
W: 0% to 0.5%;
Mo: 0% to 0.40%;
Cr: 0% to 1.0%;
Cu: 0% to 1.2%;
Ni: 0% to 0.6%;
B: 0% to 0.005%;
REM: 0% to 0.01%;
Ca: 0% to 0.01%; and
a remainder comprising Fe and impurities, wherein the steel sheet has a microstructure including, by area fraction, ferrite: 80% or more and 87.5% or less, martensite: 3% to 15.0%, and pearlite: less than 3.0%, in which a number density of martensite having an equivalent circle diameter of 3 μm or more at a position which is at a depth of ¼ of the steel sheet thickness from the surface of the steel sheet, is 5.0 pieces/10000 $\mu m^2$ or less, and the following Expression (1) is satisfied, $$R/D_M^2 \geq 1.00 \quad \text{Expression (1)},$$

here, R is an average martensite interval (μm) defined by the following Expression (2), and $D_M$ is a martensite average diameter (μm), $$R=\{12.5\times(\pi/6V_M)^{0.5}-(2/3)^{0.5}\}\times D_M \quad \text{Expression (2)},$$

here, $V_M$ is a martensite area fraction (%) and $D_M$ is the martensite average diameter (μm), and wherein the hot-rolled steel sheet has a tensile strength of 630 MPa or more.

* * * * *